United States Patent [19]

Marin et al.

[11] Patent Number: 4,990,099

[45] Date of Patent: Feb. 5, 1991

[54] KEYED ELECTRICAL CONNECTOR WITH MAIN AND AUXILIARY ELECTRICAL CONTACTS

[75] Inventors: Jorge G. Marin, Boston; Craig H. Baker, Quincy; Lester E. Wilson, Bedford, all of Mass.

[73] Assignee: High Voltage Engineering Corp., Boston, Mass.

[21] Appl. No.: 408,240

[22] Filed: Sep. 18, 1989

[51] Int. Cl.[5] ..... H01R 13/28

[52] U.S. Cl. ..... 439/284; 439/171; 439/221; 439/491; 439/681

[58] Field of Search ..... 439/171, 172, 173, 174, 439/284, 292, 293, 294, 295, 488, 491, 677, 678, 679, 680, 681, 695, 701, 221

[56] References Cited

U.S. PATENT DOCUMENTS 2,238,696 4/1941 Hanley ..... 439/491 X
3,023,394 2/1962 Hubbell ..... 439/681 X
3,794,957 2/1974 Winkler ..... 439/295
4,537,456 8/1985 Brown et al. ..... 439/293 X

FOREIGN PATENT DOCUMENTS 2806496 8/1978 Fed. Rep. of Germany ..... 439/284

*Primary Examiner*—Neil Abrams
*Assistant Examiner*—Khiem Nguyen
*Attorney, Agent, or Firm*—Richard J. Birch

[57] ABSTRACT

A hermaphroditic or "genderless" electrical connector having a main housing and an auxiliary housing. The main housing contains primary electrical contacts while the auxiliary housing provides mechanical keying and, preferably, contains auxiliary electrical contacts. The auxiliary housing can be positioned within the main housing in a plurality of orientations to provide mechanical keying when the electrical connector is telescopically engaged with a duplicate electrical connector.

11 Claims, 4 Drawing Sheets

KEYED ELECTRICAL CONNECTOR WITH MAIN AND AUXILIARY ELECTRICAL CONTACTS

BACKGROUND OF THE INVENTION

The present invention relates to electrical connectors in general, and more particularly, to a genderless electrical connector having main and auxiliary housings with the auxiliary housing providing mechanical keying of the connector and auxiliary electrical contacts.

Genderless electrical connectors are well known in the electrical connector art. Representative examples of such connectors are shown in the following U.S. Pat. Nos. 3,091,746; 3,218,599; 3,259,870; 3,654,586 and 3,794,957. The genderless type of electrical connector has gained wide acceptance in the batterymotive industry for connecting and disconnecting battery pack cables.

In the batterymotive industry, electrical charging of the vehicle's battery pack is a relatively frequent and routine operation. The charger is electrically connected to the battery pack through the battery cable connectors. After the connection is made, the charger is turned on for a predetermined period of time or until the battery pack reaches a fully charged state. The charger is then turned off and disconnected from the battery cable connector. Control of the battery charger operation can be affected through the use of auxiliary contacts that provide the de-energized making and breaking of the charger-battery cable electrical connections. U.S. Pat. No. 3,794,957 discloses a plural-poled, genderless electrical connector which provides a make first-break last electrical connection sequence for the primary electrical contacts while the auxiliary or control contacts are arranged to provide a make last-break first electrical connection sequence.

In the batterymotive industry, battery packs can provide a variety of voltages e.g., 12, 24, 36, 48 and 72 volts. It is important that the voltage of the battery pack correspond to the voltage output of the charger and to the voltage requirements of the electrical load connected to the battery pack. Although the plural-poled, genderless electrical connector described in U.S. Pat. No. 3,794,957 can be used with a variety of voltages, it does not provide any means for preventing the misconnection of electrical items having different voltages.

It is accordingly, a general object of the invention to provide a plural-poled, genderless electrical connector that includes an indexable, mechanical keying or interlocking.

It is a specific object of the invention to provide a plural-poled, genderless electrical connector having a main housing and an auxiliary housing with the auxiliary housing providing mechanical keying and auxiliary electrical connections.

It is a feature of the invention that the auxiliary housing can provide a plurality of indexing or keying positions to accommodate a corresponding plurality of voltages.

BRIEF DESCRIPTION OF THE INVENTION

The electrical connector has a main or primary housing that accommodates two primary electrical contacts with the housing and electrical contacts adapted for longitudinal telescopic engagement with a duplicate electrical connector. The auxiliary housing provides both mechanical keying and auxiliary electrical contacts. The auxiliary housing comprises a cylindrical member with two diametrically opposed male key elements at one end that are arranged to engage any pair of several key slots located within the bore of the main housing so that the auxiliary housing can be installed in a number of discrete keying positions. The opposite or telescopically engaging end of the auxiliary housing incorporates a lengthwise transverse step that mates with a similar step of another auxiliary housing in a complimentary engagement when the two properly keyed connector main housings are telescopically engaged. The rotational, indexed positions of the auxiliary housing are assigned to various application voltages. The auxiliary housing contains two sets of "pin and socket" electrical contacts held in longitudinal positions within the housing and centrally located with a contact in each of the four 90-degree quadrants of the circular cross-section of the housing. This arrangement provides for two male and two female "pin and socket" contacts which preserve the hermaphroditic connection of the auxiliary housing when the auxiliary housing is mated in longitudinal telescopic engagement with a similar and properly keyed auxiliary housing in another electrical connector.

DETAILED DESCRIPTION OF THE INVENTION

The objects and features of the invention will best be understood from a detailed description of a preferred embodiment of the invention selected for purposes of illustration and shown in the accompanying drawings in which.

DETAILED DESCRIPTION OF THE DRAWINGS

Figures 1, 2, 3:
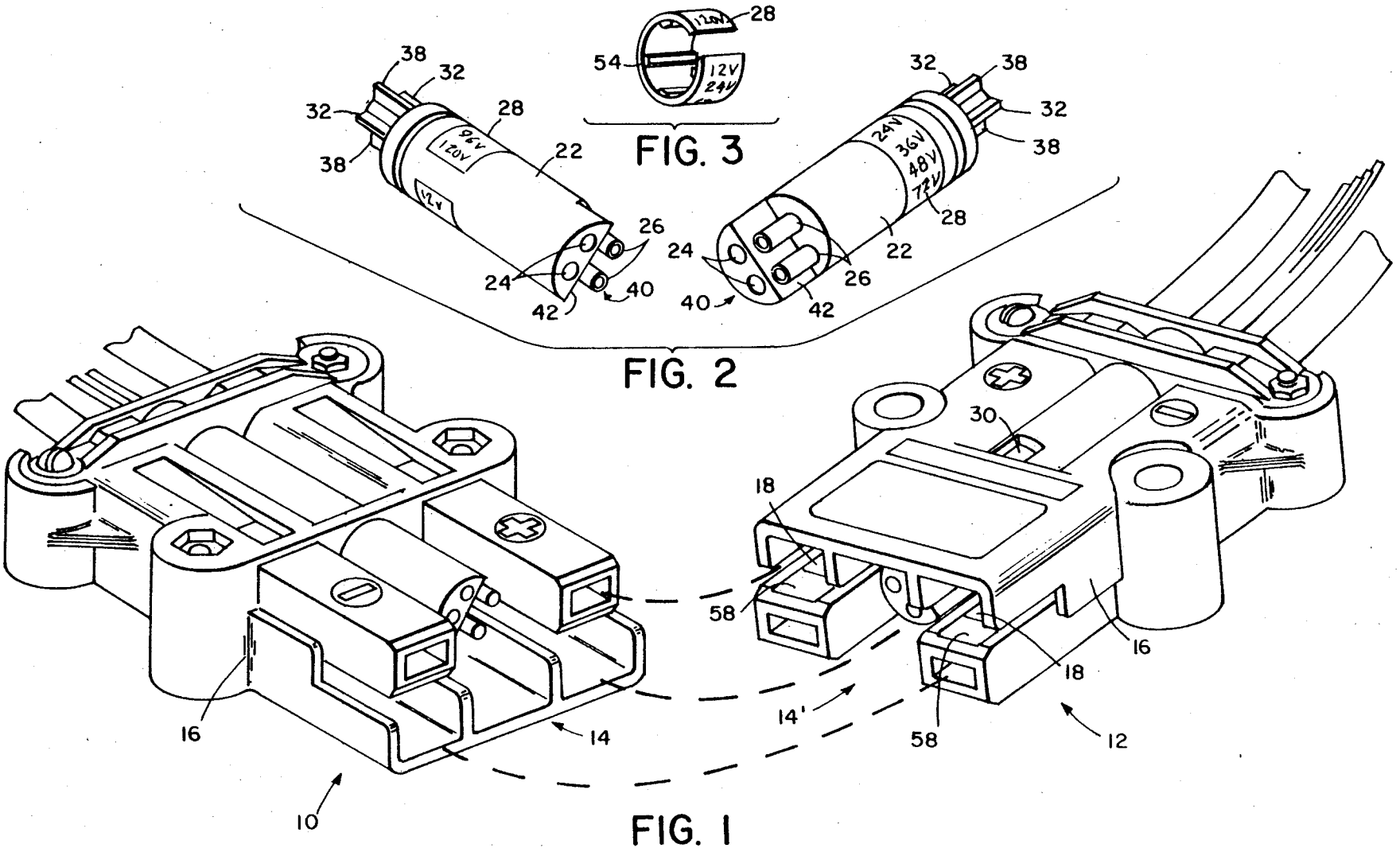
FIG. 1 is a perspective view of a pair of identical, genderless, keyed, plural-poled electrical connectors constructed in accordance with the present invention.
FIG. 2 is a view in perspective of two auxiliary electrical contact housings constructed in accordance with the present invention.
FIG. 3 is a view in perspective of a voltage indicating snap-ring band that is applied to the auxiliary housings shown in FIG. 2.
Figure 15:
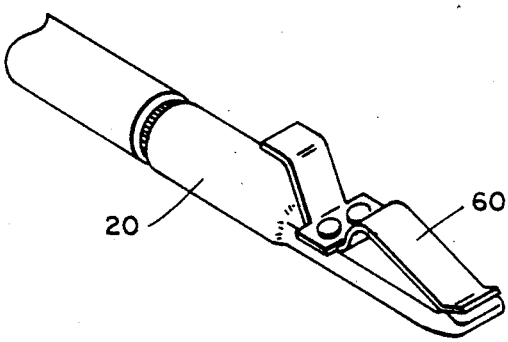
FIG. 15 is a view in perspective showing a spring biased primary electrical contact with wire attached; and, FIGS. 16A through 16C show in side elevation and partial section the sequential telescopic engagement of two electrical contacts of the electrical connector.

Referring now to the drawings, and particulary to FIG. 1 thereof, there are shown two identical plural-poled, keyed, genderless electrical connectors 10 and 12 adopted for longitudinal, telescopic engagement of their connecting ends 14 and 14' as shown by the dashed lines in FIG. 1. Each connector has a main housing 16 which provides for at least two electrical contact receiving sockets 18, best seen in FIGS. 16A through 16C, which accommodate corresponding spring-loaded electrical contacts 20 as shown in FIG. 15.

Each electrical connector main housing 16 accommodates an auxiliary housing 22 shown in FIGS. 2, 6–11 and 14. The auxiliary housing has a plurality of male auxiliary electrical contact receiving elements 24 and a corresponding plurality of female electrical contact receiving elements 26. A removable snap-ring or band 28 shown in FIG. 3 can be attached to the auxiliary housing as shown in FIG. 2 to provide a visual indication through a window 30 in the main housing of the voltage applied to the primary electrical contacts.

Figure 5:
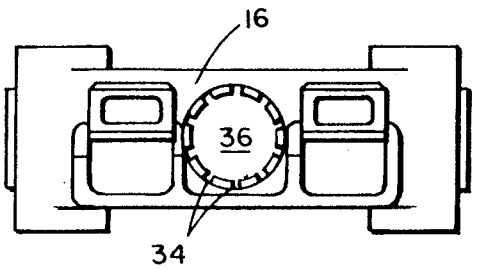
FIG. 5 is a front view of the electrical connector shown in the left-hand side of FIG. 1.
Figure 4:
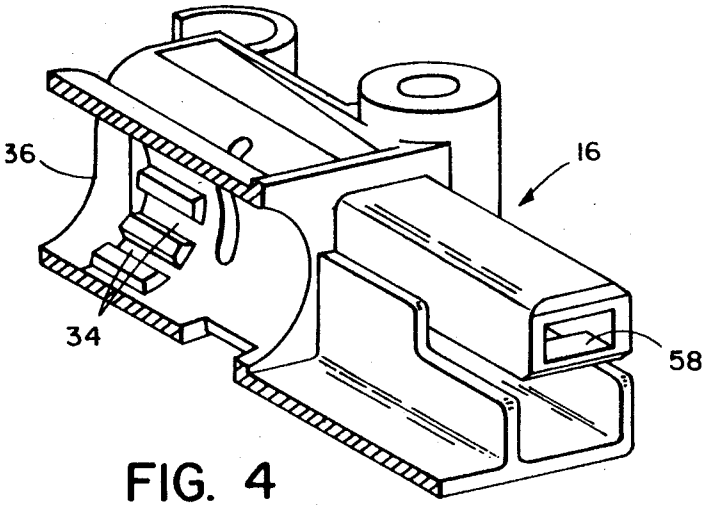
FIG. 4 is a view in perspective and partial section of a portion of the electrical connector shown in the left-hand side of FIG. 1.
Figure 11:
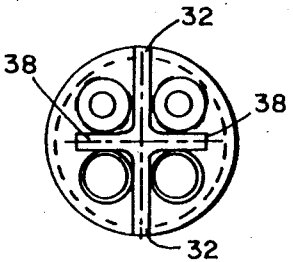
FIG. 11 is a rear view of the auxiliary housing shown in FIG. 6 and in FIG. 7 with the wires removed.

Referring to FIGS. 2, 6, 7 and 11, the auxiliary housing has two diametrically opposed male keying elements or wings 32 that are designed to fit within corresponding opposed slots 34 formed within a longitudinal bore 36 in the main housing as best seen in FIGS. 4 and 5. Referring to FIG. 11, two radially shorter male wings 38 provide electrical isolation for any electrical contacts that may be positioned within the auxiliary housing.

Referring to FIGS. 1, 2, 6, 7 and 10, the auxiliary housing 22 has a longitudinally telescoping end configuration 40 comprising a lengthwise transverse step 42 which engages the step of a correponding properly positioned housing of another electrical connector. It will be appreciated that the auxiliary housing can be mounted within the main housing in a plurality of keyed or indexed positions that are circumferentially spaced around the main housing bore 36.

In order for the two electrical connectors 10 and 12 to mate, one connector must be inverted relative to the other as shown in FIG. 1 and if the rotational positions of the auxiliary housings are such that the complimentary transverse longitudinally extending steps are at any angular index position other than lateral, the installation of the auxiliary housings in the two main housings must be different. Specifically, one auxiliary housing must be indexed clockwise while the other is indexed counterclockwise in order for the two mechanical key steps 42 to be complimentary when one connector main housing is inverted with respect to the other housing.

Figure 9:
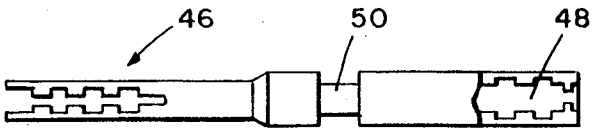
FIG. 9 is a view in side elevation of a female auxiliary contact for use in the auxiliary housing of FIG. 2.
Figure 8:
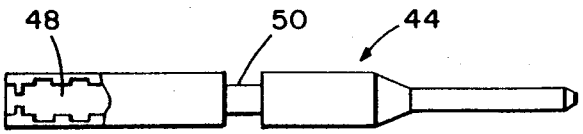
FIG. 8 is a view in side elevation of a male contact for use in the auxiliary housing of FIG. 2.
Figure 13:
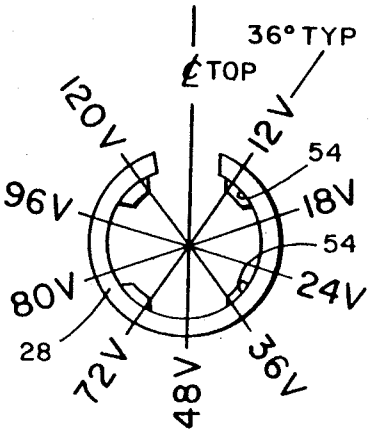
FIG. 13 is a end view of the snap-ring shown in FIG. 3 depicting the location of the voltage indicia shown in FIGS. 1, 2, 3 and 7.

The auxiliary housing accommodates both the male and female auxiliary electrical contacts 44 and 46 shown in side elevation in FIGS. 8 and 9, respectively. The male and female auxiliary contacts each contain a bore 48 for receiving an electrical wire (not shown). The electrical wire can be soldered to the auxiliary electrical contact or the contact itself can be crimped around the wire.

Figure 14:
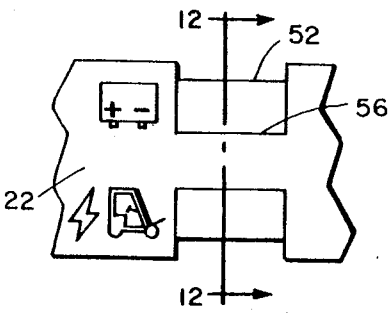
FIG. 14 is a plan view of a portion of the auxiliary housing of FIGS. 6 and 7 showing the indicia for a battery pack and a battery-powered vehicle.
Figure 6:
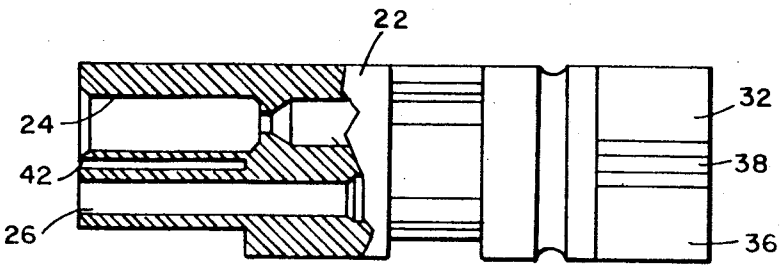
FIG. 6 is a view in side elevation partially broken-away showing one of the auxiliary housings depicted in FIG. 2.
Figure 7:
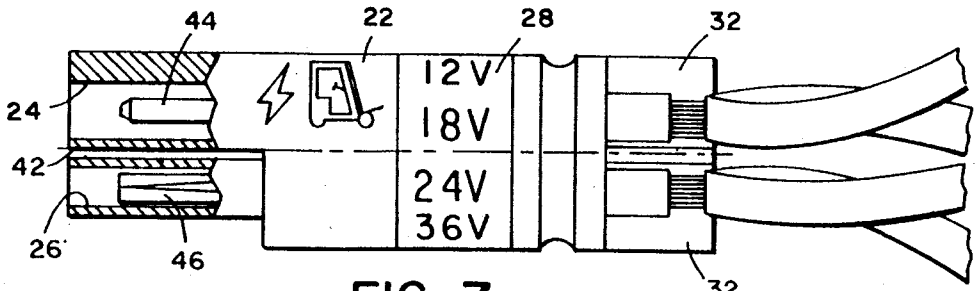
FIG. 7 is another view in side elevation and partially broken-away showing one of the auxiliary housings of FIG. 2 with a pair of male and female electrical contacts positioned therein.
Figure 12:
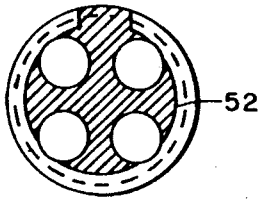
FIG. 12 is a view in section taken along line 12—12 in FIG. 14.
Figure 10:
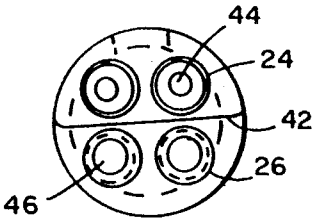
FIG. 10 is a front view of the auxiliary housing shown in FIG. 7.

Each auxiliary electrical connector has a reduced diameter portion 50. When the male and female auxiliary electrical contacts are mounted in the auxiliary housing as shown in FIGS. 7, 10 and 11, the removable snap-ring 28 is positioned around the reduced diameter portion 50 of the auxiliary electrical contact. Since the normal diameter of the auxiliary contact extends beyond the reduced diameter portion 52 of the auxiliary housing as shown in FIGS. 12 and 14, the snap-ring tabs 54 serve to hold the auxiliary electrical contacts within the auxiliary housing.

As discussed above, the removable snap-ring 28 has voltage identifying indicia printed thereon. Since the rotational nomenclature of the auxiliary housing is located on the removable snap-ring or identification band, the band takes the form of an incomplete ring which engages the reduced diameter portion of the auxiliary housing 52. This portion of the auxiliary housing has a blocking element 56 to prevent relative rotation of the snap-ring band while permitting alternative mounting of the band so that voltage nomenclature can be read either clockwise or counterclockwise. In this manner, alternate mounting of the bands in a pair of electrical connectors maintains the proper voltage nomenclature through the viewing port 30 of the connector main housing (with one inverted) and facilitates the mechanical keying and auxiliary contact connection.

Referring now to FIGS. 1, 15 and 16A through 16C, each spring-loaded primary or main electrical contact 20 is located within the contact receiving socket of the main housing. The telescoping end of each electrical contact socket 18 has a bridging element 58 which prevents access to the contact by a human finger.

Figure 16C:
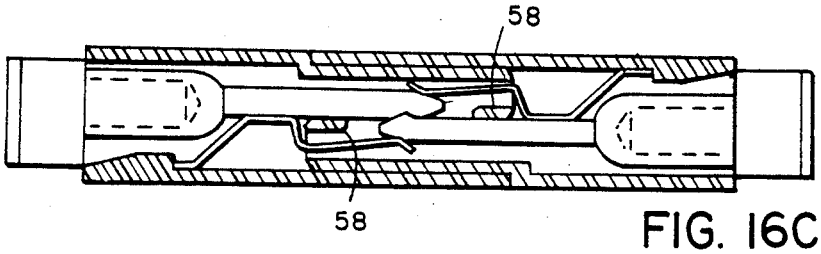
Figure 16B:
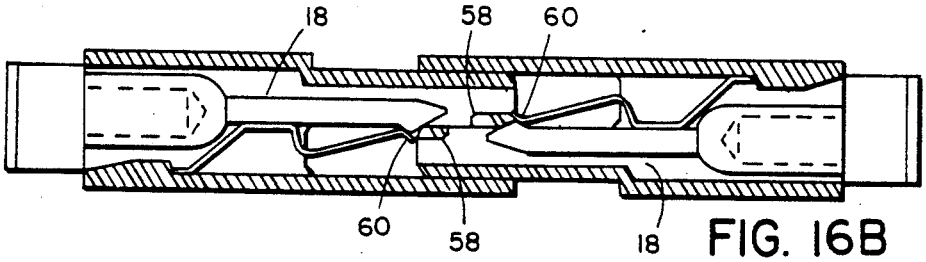
Figure 16A:
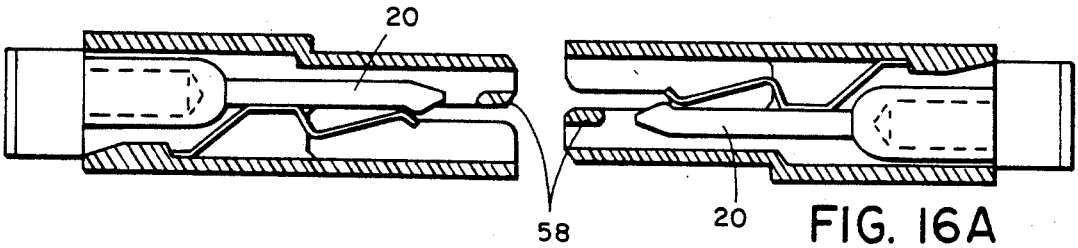

The longitudinal telescopic engagement of a pair of primary contacts of two of the electrical connectors of the present invention is shown sequentially in FIGS. 16A throughf 16C. As the two housings move together into contact as shown in FIGS. 16B, the primary contact's spring 60 engages the corresponding bridge 58 of the other electrical connector and is forced inwardly into the contact receiving socket so that it ultimately bears against the opposite primary electrical contact as shown in FIG. 16C. This arrangement insures a good electrical connection and facilitates a wiping cleaning action as the two contacts engage and disengage.

Having described a preferred embodiment of the invention, it will now be apparent to those skilled in the art that numerous modifications can be made therein without departing from the scope of the invention as defined in the following claims. For example, although the auxiliary housing has been shown as a cylindrical member which fits within a corresponding cylindrical bore in the main housing, other transverse geometric shapes such as pentagonal or hexagonal can be used for the shape of the auxiliary housing and the shape of the corresponding bore in the main housing.

What we claim is:

1. A keyed genderless electrical connector comprising:

A. a main housing means having (i) first and second main electrical contact receiving means, and (ii) first and second genderless main electrical contacts positioned within said corresponding first and second main electrical contact receiving means, respectively, B. a longitudinally extending auxiliary housing means having (i) a plurality of auxiliary electrical contact receiving means, and (ii) a plurality of auxiliary electrical contacts positioned within said corresponding plurality of auxiliary electrical contact receiving means, said auxiliary housing means being rotationally positioned about its longitudinal axis with respect to said main housing means to provide a key for the electrical connector that prevents the electrical connector from being mated with a duplicate but differently keyed electrical connector.

2. A keyed genderless electrical connector comprising:

A. a main housing means having (i) first and second main electrical contact receiving means, (ii) first and second genderless main electrical contacts positioned within said corresponding first and second main electrical contact receiving means, respectively, and, (iii) longitudinally extending bore means having a transverse geometric configuration that defines a plurality of indexing means spaced from and angularly positioned around the longitudinal axis of said longitudinally extending bore means;

B. a longitudinally extending auxiliary housing means adapted for positioning in said main housing longitudinally extending bore means and having (i) a plurality of auxiliary electrical contact receiving means, (ii) means defining a keying element, (iii) means cooperative with said main housing indexing means for positioning said longitudinally extending auxiliary housing means with respect to a selected one of said plurality of indexing means whereby the mating keying means is rotationally keyed with respect to the main housing to prevent the electrical connector from being mated with a duplicate but differently keyed electrical connector.

3. A keyed genderless electrical connector comprising:

A. a main housing means having (i) first and second main electrical contact receiving means, (ii) first and second genderless main electrical contacts positioned within said corresponding first and second main electrical contact receiving means, respectively, and, (iii) longitudinally extending bore means having a transverse geometric configuration that defines a plurality of indexing means spaced from and angularly positioned around the longitudinal axis of said longitudinally extending bore means;

B. a longitudinally extending auxiliary housing means adapted for positioning in said main housing longitudinally extending bore means and having (i) a plurality of auxiliary electrical contact receiving means, (ii) a plurality of auxiliary electrical contacts positioned within said corresponding plurality of auxiliary electrical contact receiving means, (iii) means defining a mating key element, and, (iv) means cooperative with said main housing indexing means for positioning said longitudinally extending auxiliary housing means with respect to a selected one of said plurality of indexing means whereby the mating keying element is rotationally keyed with respect to the main housing to prevent the electrical connector from being mated with a duplicate but differently keyed electrical connector.

4. The keyed genderless electrical connector of claim 3 wherein said main housing means longitudinally extending bore means has a generally cylindrical shape with a plurality of longitudinally extending internal splines and lands with two of said splines and the intermediate land comprising one of said indexing means.

5. The keyed genderless electrical connector of claim 4 wherein said longitudinally extending auxiliary housing means has a generally cylindrical shape and a plurality of radially extending wings each adapted to fit within an intermediate land between two adjacent splines whereby said longitudinally extending auxiliary housing means is rotationally indexed with respect to the longitudinal axis of said longitudinally extending bore means.

6. The keyed genderless electrical connector of claim 3 wherein said longitudinally extending auxiliary housing means includes a longitudinally telescoping end configuration having a predetermined transverse configuration for engaging the corresponding longitudinally extending auxiliary housing means of a duplicate electrical connector that is identically keyed.

7. The keyed genderless electrical connector of claim 6 wherein said longitudinally telescoping end configuration comprises a longitudinally extending transverse step means.

8. The keyed genderless electrical connector of claim 3 wherein said longitudinal extending auxiliary housing means has four auxiliary electrical contact receiving means with one of said four auxiliary electrical contact receiving means being positioned in each 90° section around the longitudinal axis of said longitudinally extending auxiliary housing means.

9. The keyed genderless electrical connector of claim 8 wherein two male auxiliary electrical contacts are positioned in two corresponding auxiliary electrical contact receiving means that are located in one 180° sector and two female auxiliary electrical contacts are positioned in the two other auxiliary electrical contact receiving means located in the other 180° sector.

10. The keyed genderless electrical connector of claim 3 further comprising means for holding said auxiliary electrical contacts within said longitudinally extending auxiliary housing.

11. The keyed genderless electrical connector of claim 3 wherein said main housing means includes a window means through which a portion of said longitudinally extending auxiliary housing is visible and wherein said longitudinally extending auxiliary housing includes indicia that are visible through said window means.

* * * * *